US006817053B2

(12) United States Patent
Nakamura

(10) Patent No.: US 6,817,053 B2
(45) Date of Patent: Nov. 16, 2004

(54) HAIRBRUSH

(76) Inventor: Tetuji Nakamura, 3400-1, Tabeta, Kawanabe-cho, Kawanabe-gun, Kagoshima (JP)

( * ) Notice: Subject to any disclaimer, the term of this patent is extended or adjusted under 35 U.S.C. 154(b) by 159 days.

(21) Appl. No.: 10/170,303

(22) Filed: Jun. 12, 2002

(65) Prior Publication Data

US 2003/0009838 A1 Jan. 16, 2003

(30) Foreign Application Priority Data

Jun. 13, 2001 (JP) ..... 2001-178662

(51) Int. Cl.[7] ..... A46B 9/02

(52) U.S. Cl. ..... 15/160; 15/160; 15/207.2; 15/DIG. 5; 15/DIG. 6

(58) Field of Search ..... 15/207.2, DIG. 5, 15/DIG. 6, 160

(56) References Cited

U.S. PATENT DOCUMENTS

| | | | | |
|---|---|---|---|---|
| 2,267,498 A | * | 1/1941 | Foliot | |
| 3,047,898 A | * | 6/1962 | Levite | |
| 3,727,260 A | * | 4/1973 | Spydevold | 15/159 A |
| 4,730,361 A | * | 3/1988 | Koffler | 15/160 |
| 6,341,611 B1 | * | 1/2002 | Nakamura | 132/120 |

* cited by examiner

*Primary Examiner*—Deborah Jones
*Assistant Examiner*—Abraham Bahta
(74) *Attorney, Agent, or Firm*—Koda & Androlia

(57) ABSTRACT

A hairbrush has a brush base member and brush bristles provided thereon. Some of the brush bristles have supplemental bristles at positions lower than the middle positions of the brush bristles. Hair is easily entangled on the brush bristles and prevented from unwanted slipping off. The hairbrush makes it easy to style hairdos.

5 Claims, 13 Drawing Sheets

HAIRBRUSH

FIELD OF THE INVENTION

The present invention relates to a hairbrush that is suitable for styling hairdos by blowing hair to flow softly or curling hair.

PRIOR ART

Some conventional hairbrushes have plural rows of brushing bristles longitudinally provided along with a flat brush base, and some others have plural radial rows of brushing bristles longitudinally provided along with a cylindrically shaped brush base.

The brush bristles of these conventional hairbrushes are made of hard bristles of synthetic resin or bundles of soft bristles.

PROBLEMS TO BE SOLVED BY THE INVENTION

In case of styling hairdos by blowing hair (to make hair flow softly) or curling hair with a hairbrush, hair is first applied with a necessary amount of hair lotion. And hair is caught and entangled on the hard or soft brush bristles, then pulled and raised, or caught and entangles around the brush base and warmed by a hair dryer to be given waves and curls.

In case of a conventional hairbrush having bundles of soft brush bristles, hair can be entangled on the brush bristles without slipping off therefrom. However, hair does not enter down to the root portions of the brushing bristles and is easy to slip off from the brush bristles. Therefore, while being warmed by a hair dryer and given waves and curls thereon, hair is likely to slip off from the brush bristles. Styling hairdos by blowing or curling hair with it is not easy.

Furthermore, in case of a conventional hairbrush having hard brush bristles, hair readily slips off and will not appropriately twine on the brush bristles. Therefore when being warmed by a hair dryer to receive curls and waves thereon, hair readily slips off from the hairbrush. So styling hairdos by blowing or curling hair with it is not easy.

It is hence an object of the present invention to provide a hairbrush with which the above problems will not happen. More particularly, it is an object of the present invention to provide a hairbrush with which hair is easily entangled on the brush bristles, held thereon without easily slipping off, and favorable hairdos are made by blowing and/or curling hair.

MEANS TO SOLVE THE PROBLEM

In order to solve the above stated problems, a hairbrush according to the present invention has supplemental bristles below middle positions between the tips and the roots of the brush bristles.

In the hairbrush according to the present invention, the brush bristles may be made of hard bristles and the supplemental bristles may be of soft bristles.

Furthermore, in the hairbrush according to the present invention, the supplemental bristles may be longitudinally provided on the brush base member, and on sides of some of the brush bristles and slanted from the tip sides of the bristles toward the root sides thereof.

Moreover, in the hairbrush according to the present invention, the supplemental bristles may be provided longitudinally on the brush base member, and on one sides of some of the brush bristles and slanted from the tip sides of the bristles toward the root sides thereof, and furthermore intersect with the neighboring brush bristles.

In addition, the hairbrush according to the present invention, the supplemental bristles may be longitudinally provided on the brush base, and on both sides of some of the brush bristles and slanted from the tip sides of the bristles toward the root sides thereof and furthermore intersect with adjacent supplemental bristles on the neighboring brush bristles.

The above and other objects, features and advantages of the present invention will become apparent from the following description read in conjunction with the accompanying drawings, in which like reference numerals designate the same elements.

DETAILED DESCRIPTION OF THE INVENTION

Figure 1:
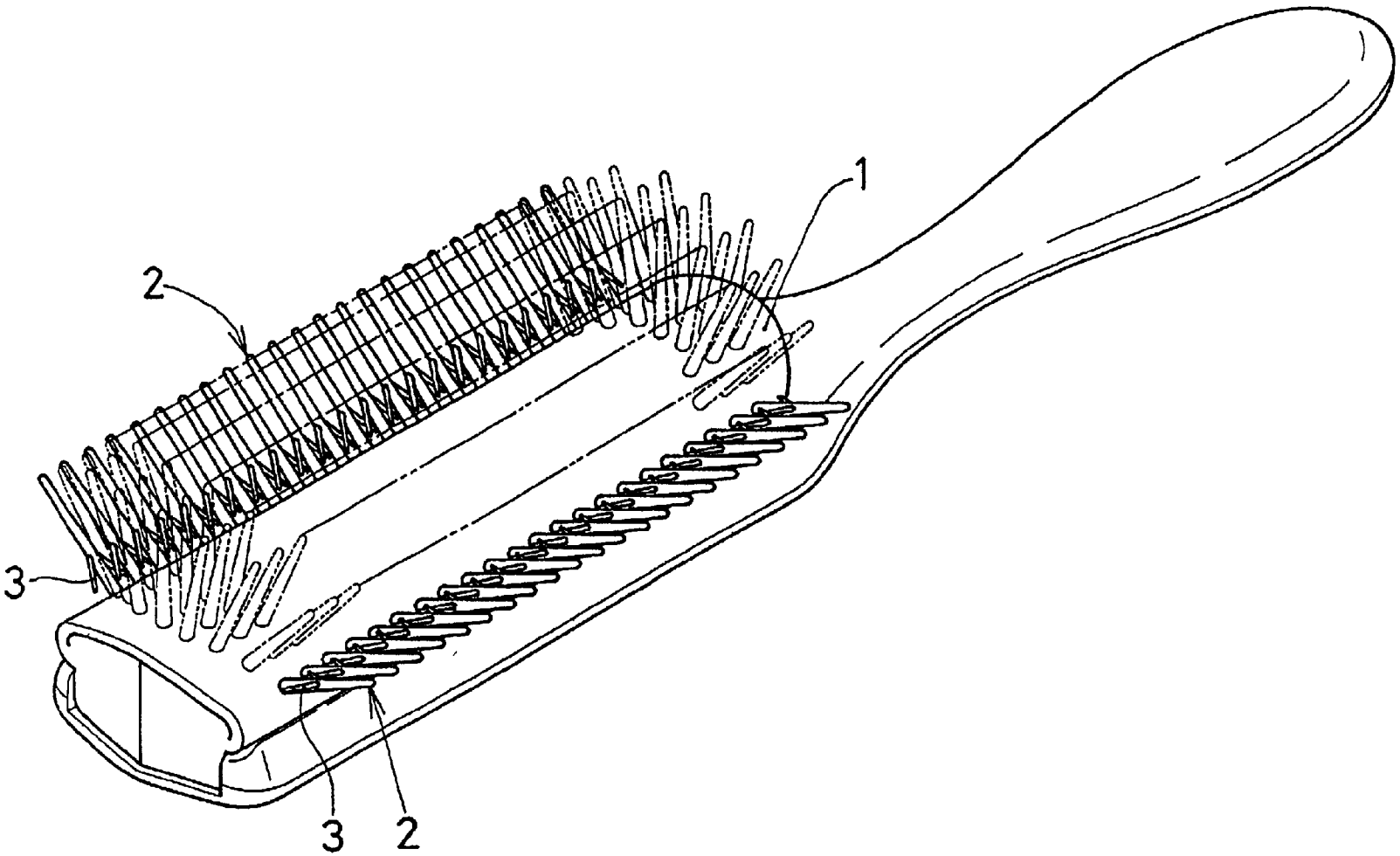
FIG. 1 is a perspective view of an embodiment of a hairbrush according to the present invention.
Figure 2:
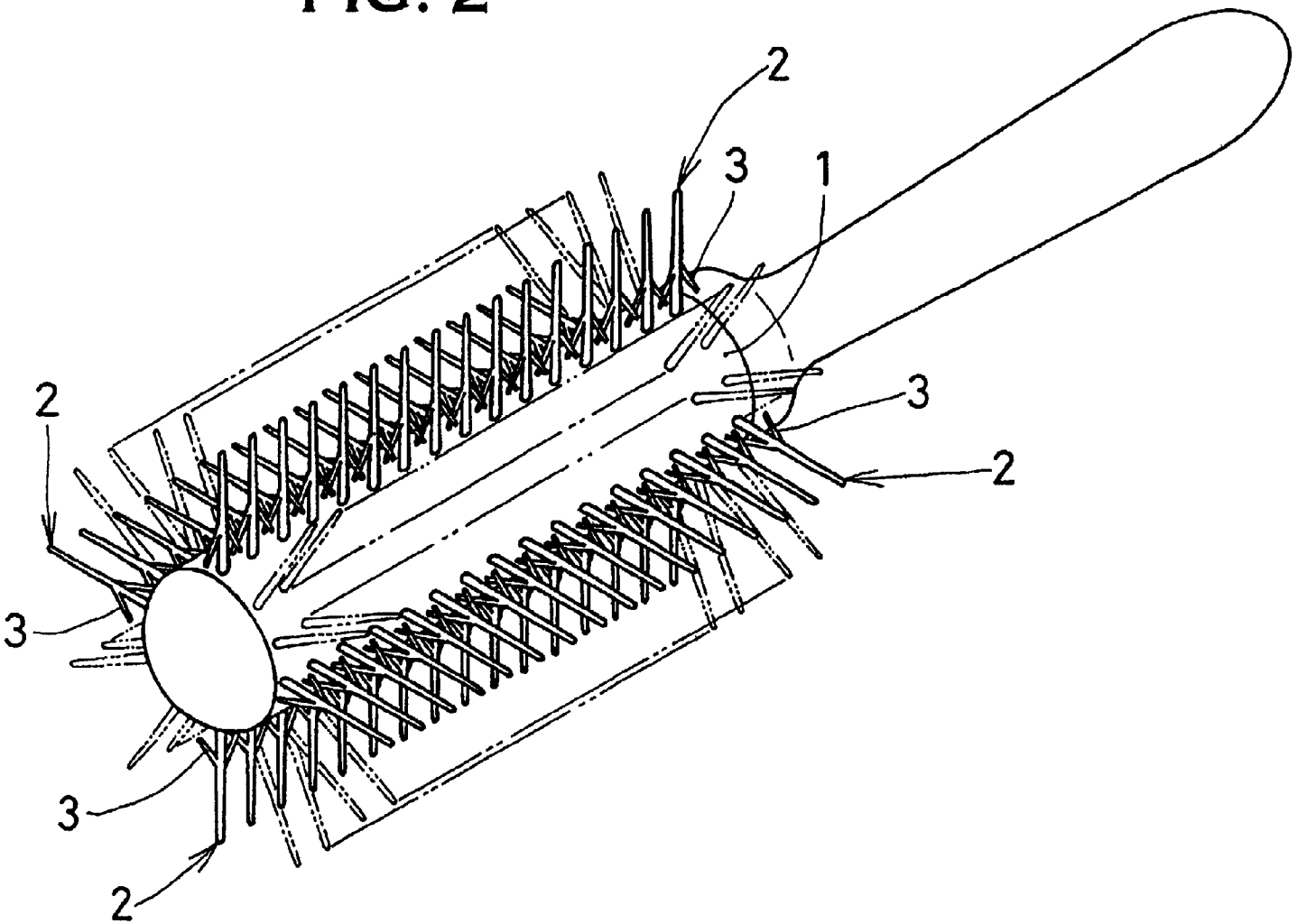
FIG. 2 is a perspective view of another embodiment of a hairbrush according to the present invention.
Figure 3:
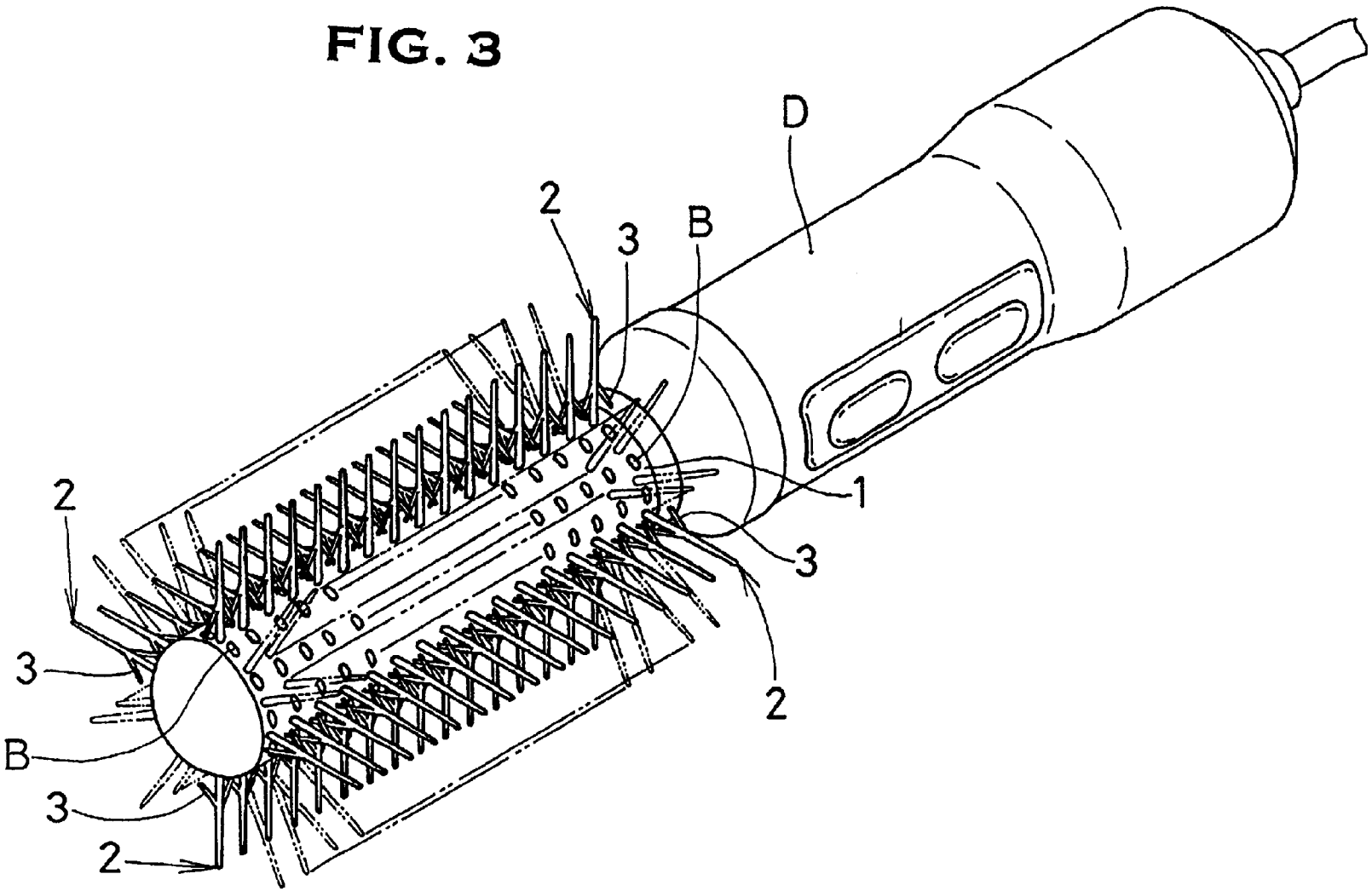
FIG. 3 is a perspective view of another embodiment of a hairbrush according to the present invention.

An embodiment of a hairbrush according to the present invention is illustrated in FIG. 1. The hairbrush includes a substantially flat brush base member 1 and plural rows of brush bristles 2 provided longitudinally on the brush base member 1. Another embodiment of a hairbrush according to the present invention is illustrated in FIG. 2. The hairbrush includes a substantially cylindrical brush base member 1 and plural rows of brush bristles 2 provided radially and longitudinally on the brush base member 1. Another embodiment of a hairbrush according to the present invention is illustrated in FIG. 3. The hairbrush includes a substantially cylindrical brush base member 1, plural rows of brush bristles 2 provided radially and longitudinally on the brush base member 1, and a plurality of small apertures B on the brush base member 1 through which warmed air from a hairdryer D blows out. The hairdryer D may be attached on the bottom-end of the brush base member 1. Further another embodiment of a hairbrush according to the present invention, not shown though, may include a substantially flat, hollow brush base member 1, plural rows of brush bristles 2 provided longitudinally on the brush base member 1, and a plurality of small apertures B on the brush base member 1 through which warmed air from a hairdryer D blows out. The hairdryer D may be attached to the bottom-end of the brush base member 1. All or some of the foregoing plural rows of brush bristles 2 respectively have supplemental bristles 3 at positions lower than the middle positions between the tips and roots of the bristles 2. In the embodiment in FIG. 1, only two rows located at the both lateral ends of the brush base member 1 have supplemental bristles 3 at positions lower than the middle positions between the tips and roots of the respective brush bristles 3. In the embodiments in FIGS. 2 and 3, two pairs of opposing rows of the brush bristles 2 (i.e. four rows in total, and each pair being at substantially 180° intervals) respectively have supplemental bristles 3 at positions lower than the middle positions between the tips and roots of the brush bristles 2.

The brush bristles 2 may be hard bristles made of stick matters of metal or synthetic resin. Or they may be soft bristles made of animal bristles or synthetic resin and bundled together. The brush bristles 2 made of hard bristles may be reliably kept in a standing state, so that they are preferable to be provided with supplemental bristles thereon.

The supplemental bristles 3 may be hard bristles made of stick matters of metal or synthetic resin, or soft bristles made of natural animal bristles (such as hog bristles) or synthetic bristles (such as nylon bristles). The latter soft bristles are preferable because hair presses the soft bristles in use and causes them to be bent and thereby the hair may enter deep to the root portions of the brush bristles 2.

Figure 4:
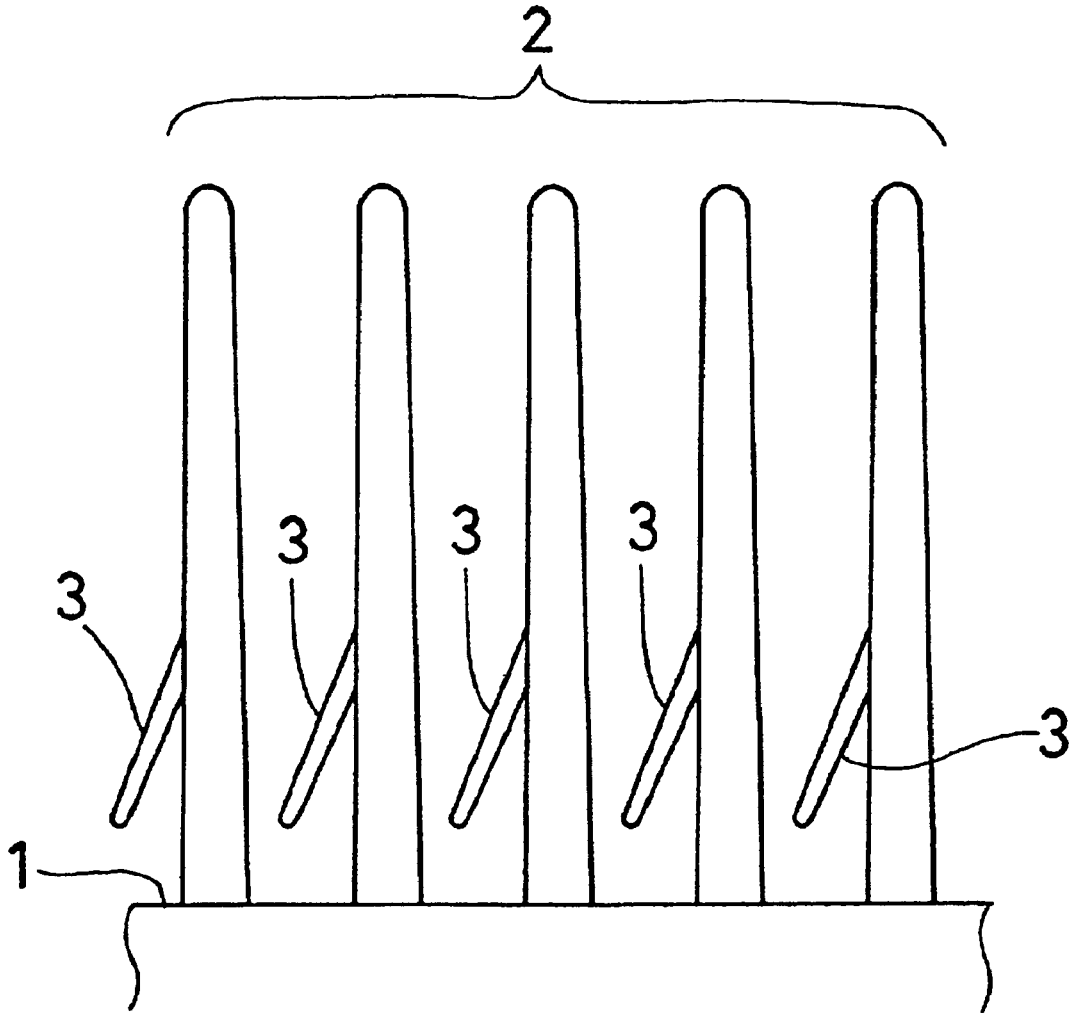
FIG. 4 is an enlarged view showing an example of supplemental bristles of an embodiment of a hairbrush according to the present invention.
Figure 5:
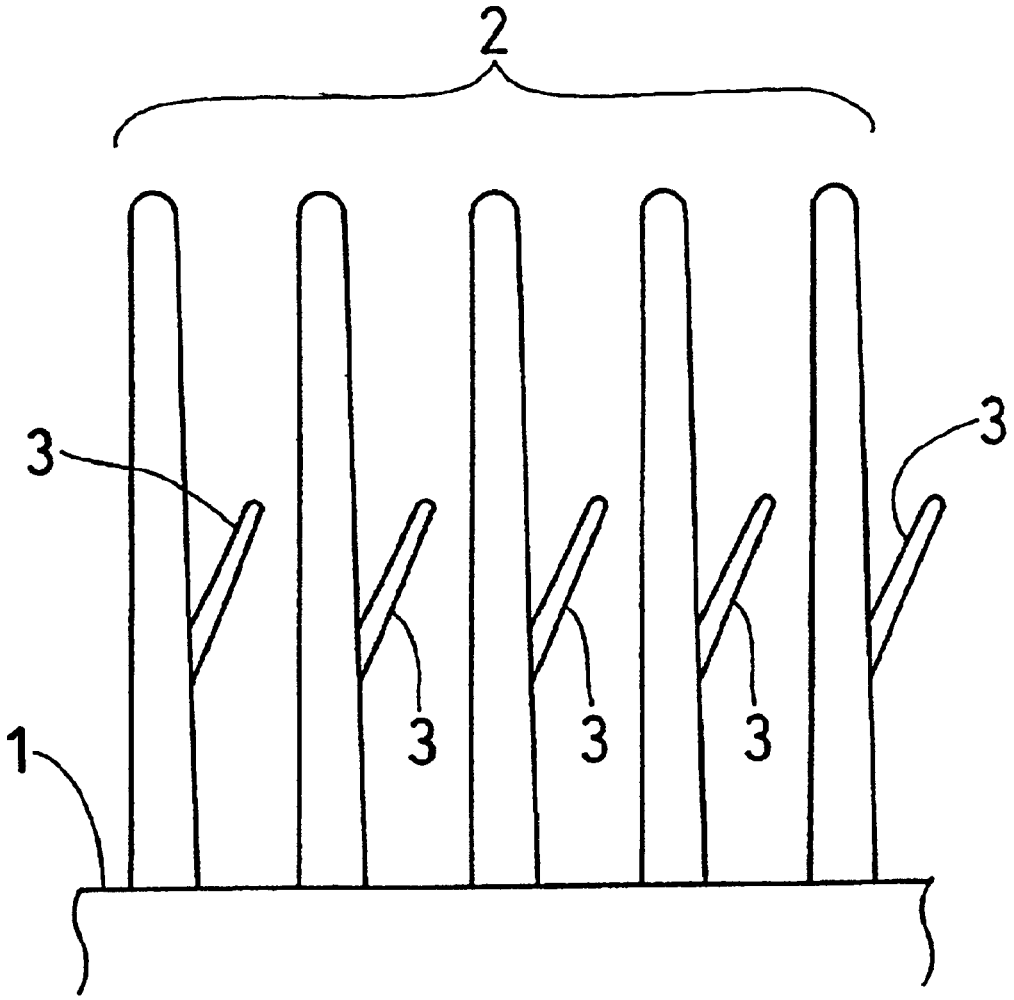
FIG. 5 is an enlarged view showing another example of supplemental bristles of an embodiment of hairbrush according to the present invention.

The supplemental bristles 3 are provided longitudinally on the brush base member 1 and on ones side of the respective brush bristles 2. Respective supplemental bristles 3 are preferably slant from the tip sides toward the root sides (i.e. downwardly) of the brush bristles 2, as shown in FIG. 4, so that hair easily comes down to the root portions of the brush bristles 2. The supplemental bristles 3 are, if needed, alternatively being slant from the root sides toward the tip sides (i.e. upwardly) of the brush bristles as shown in FIG. 5. When the supplemental bristles 3 are slant downwardly as shown in FIG. 4, it is preferable to make the supplemental bristles 3 intersect with the neighboring brush bristles 2. So that hair may readily enter deep to the root portions of the brush bristles 2 and be prevented from unwanted slipping off from the root portions of the brush bristles 2.

Figure 6:
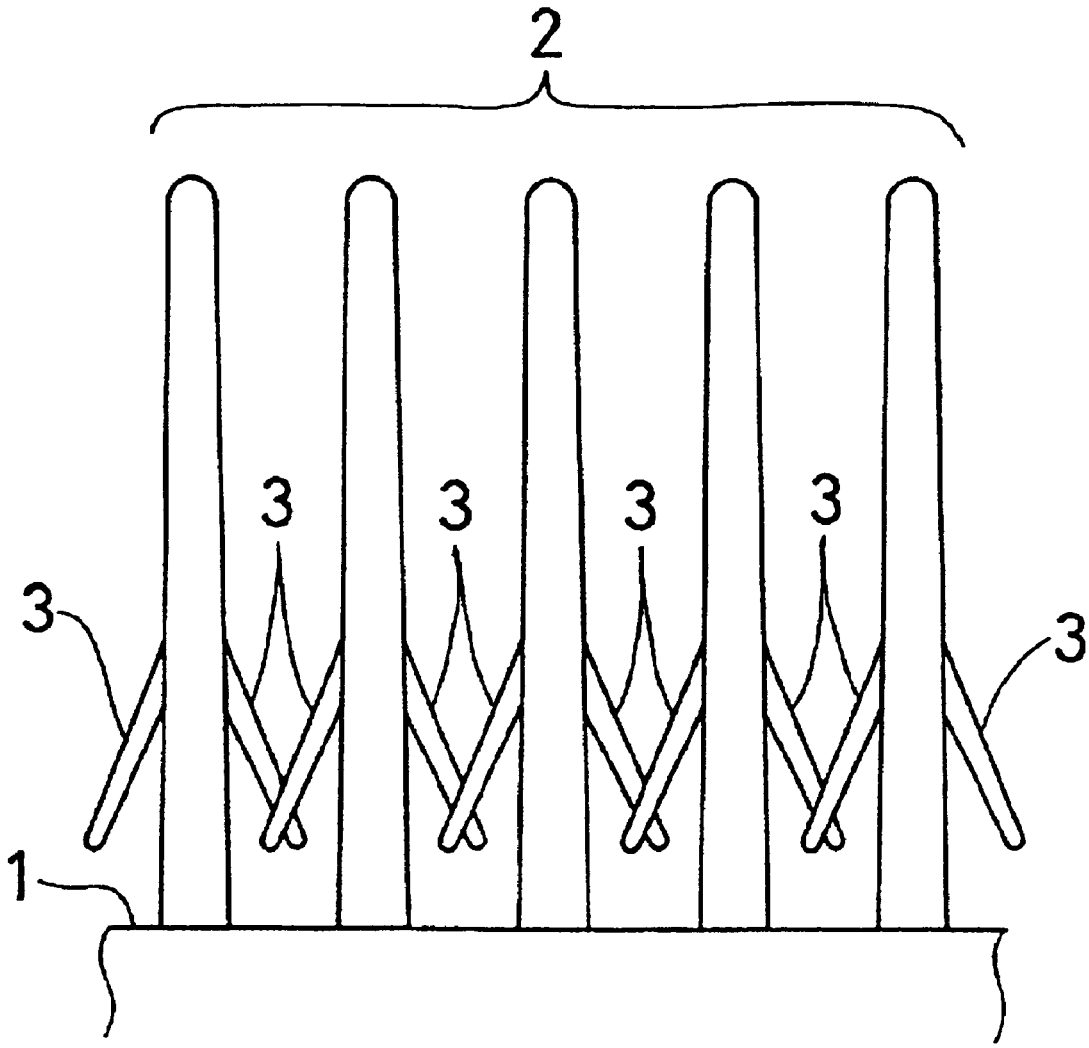
FIG. 6 is an enlarged view showing another example of supplemental bristles of an embodiment of a hairbrush according to the present invention.

Furthermore, the supplemental bristles 3 may be provided longitudinally on the brush base member 1 and on both sides of respective brush bristles as shown in FIG. 6. In this case, it is advisable to make the supplemental bristles 3 on the neighboring brush bristles 3 intersect with each other. With this construction, hair may easily come down to the root portions of the brush bristles 3 and caught there, and the caught hair may be reliably prevented from unwanted slipping off from the root portions of the brush bristles 2.

Figure 7:
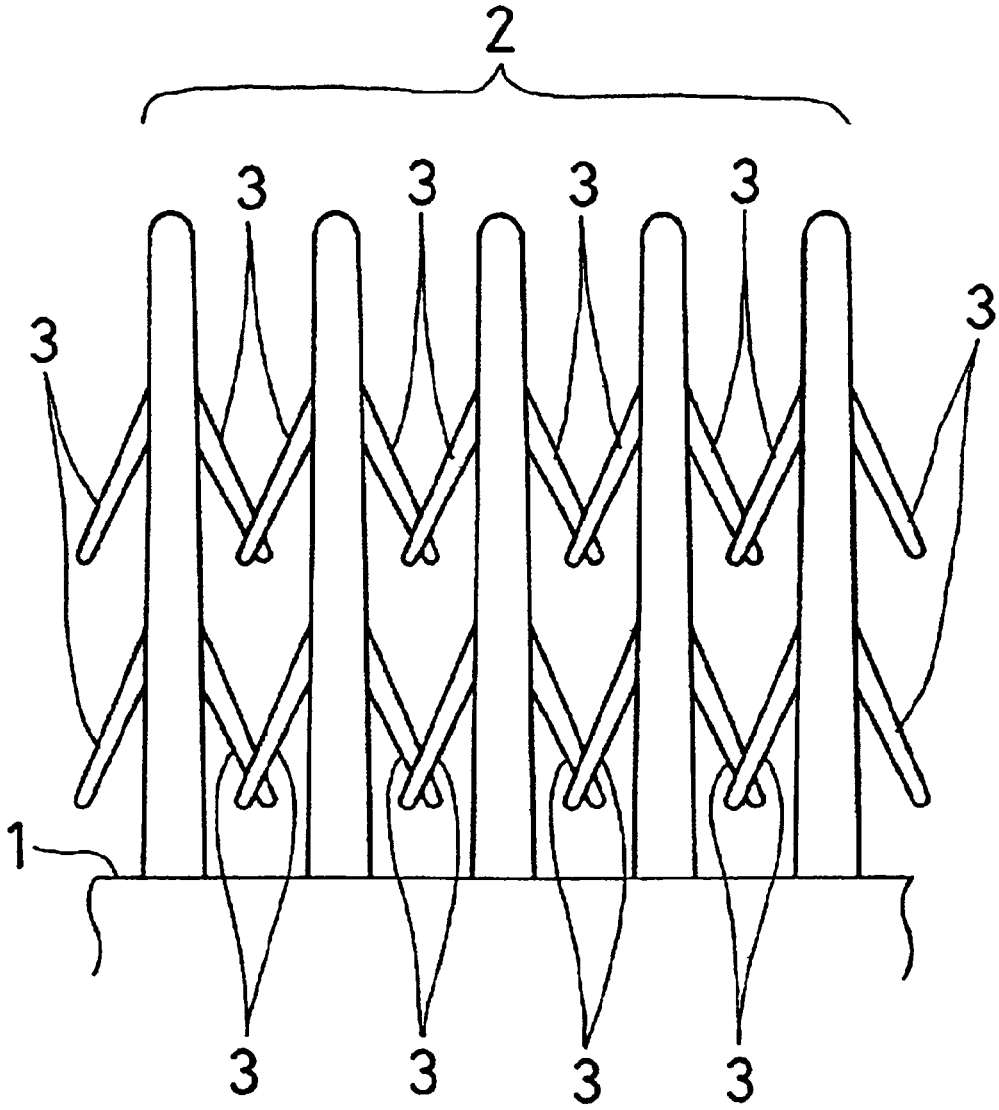
FIG. 7 is an enlarged view showing another example of supplemental bristles of an embodiment of a hairbrush according to the present invention.
Figure 8:
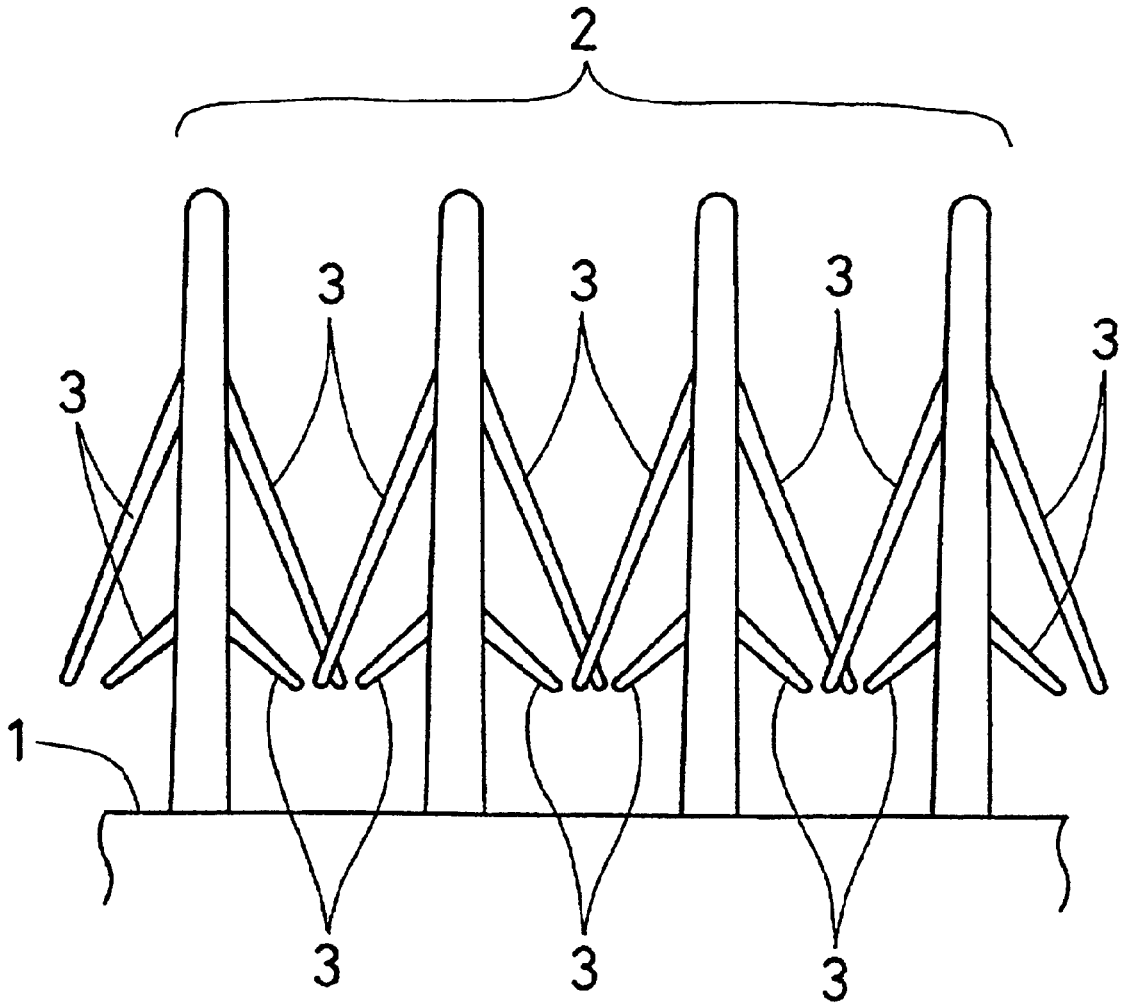
FIG. 8 is an enlarged view showing another example of supplemental bristles of an embodiment of a hairbrush according to the present invention.

Further as shown in FIGS. 7 and 8, the supplemental bristles 3 may be provided on the brush bristles 2 longitudinally disposed on the brush base member 1, and plural supplemental bristles 3 are provided on both sides of the respective brush bristles 2. In this embodiment, all or some of the supplemental bristles 3 may be made to intersect with those on the neighboring brush bristles 2. In FIG. 7, two of the supplemental bristles are respectively provided on both sides of the brush bristles 2 (two on one side and two on the other side), and both of the two supplemental bristles 3 intersect with the respective supplemental bristles 3 on the neighboring brush bristles 2. On the other hand, in FIG. 8, in which two of supplemental bristles 3 are respectively provided on both sides of the brush bristles 2 like in FIG. 7, only the upper supplemental bristles 3 intersect with the associated upper supplemental bristles on the neighboring brush bristle 2, but the lower supplemental bristles 3 does not intersect with the lower supplemental bristles on the neighboring brush bristles 2. Although not shown herein, plural supplemental bristles may be provided on one sides of respective brush bristles 2 disposed longitudinally on the brush base member 1. In this case, also, the supplemental bristles 3 may be disposed intersecting with the neighboring brush bristles 2.

Figure 9:
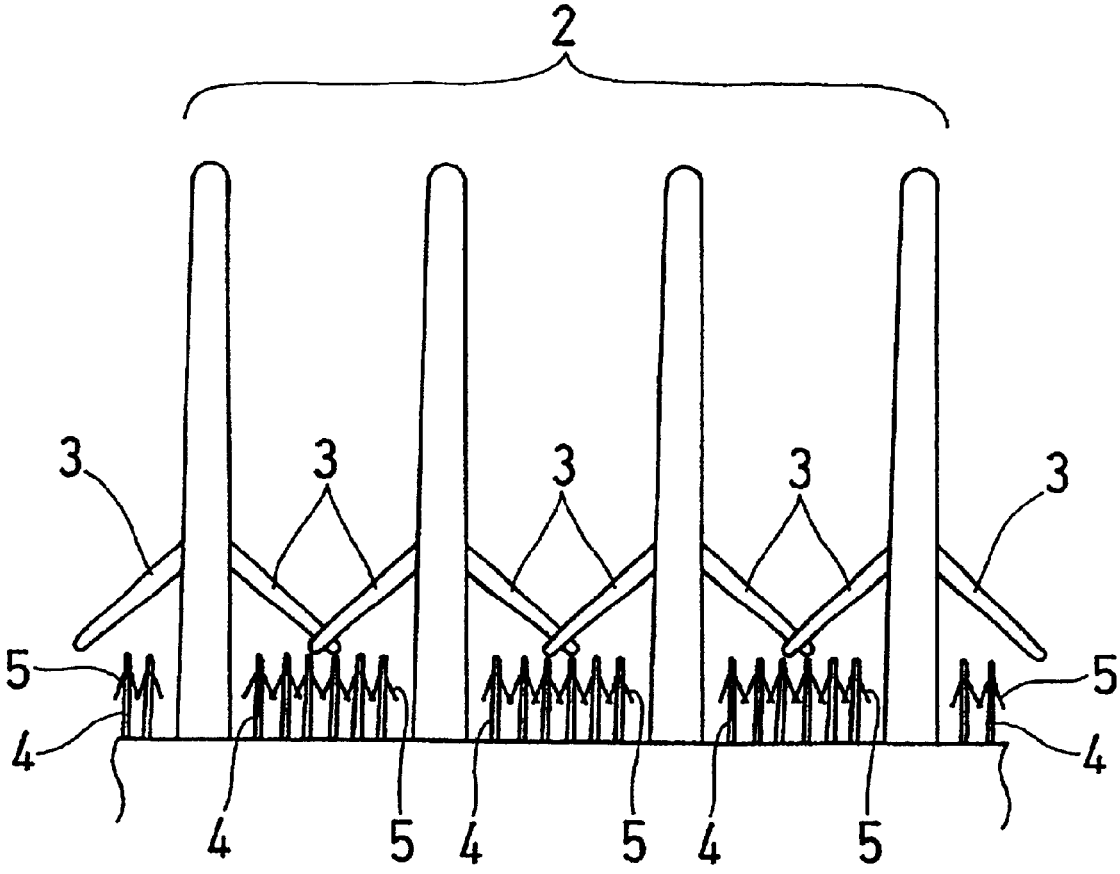
FIG. 9 is an enlarged view showing another example of supplemental bristles of an embodiment of a hairbrush according to the present invention.
Figure 10:
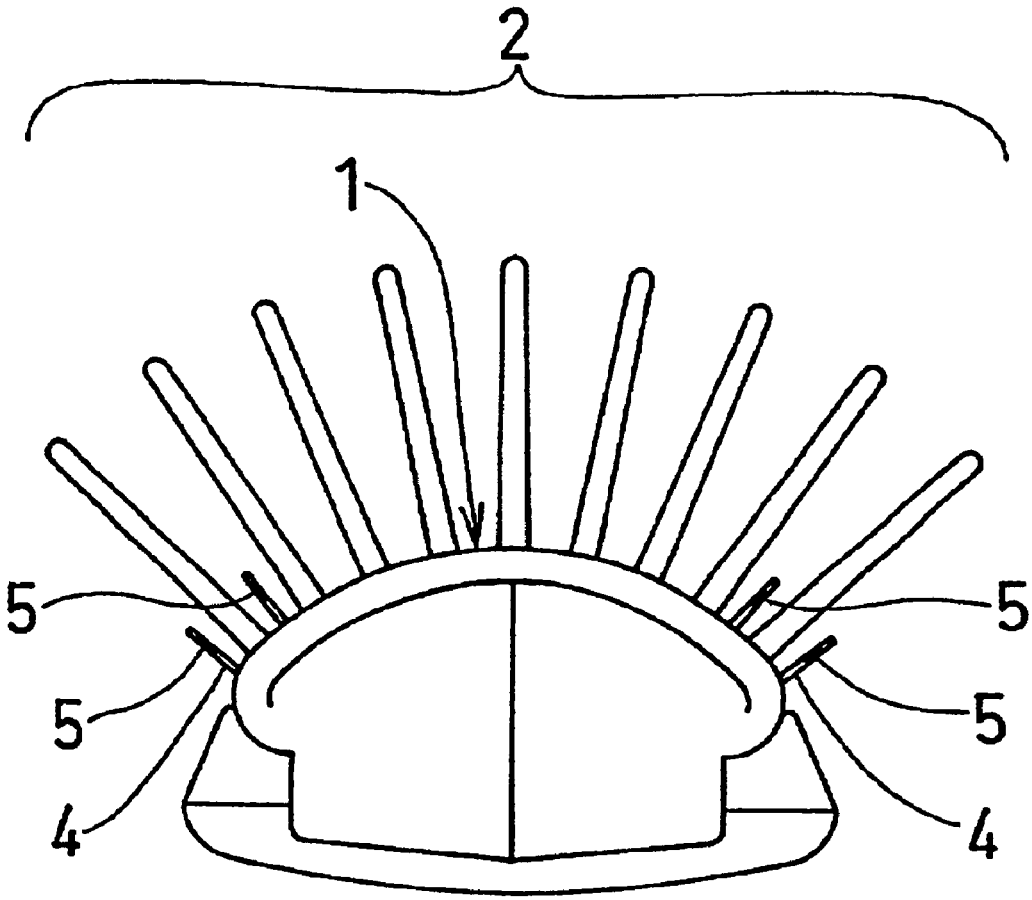
FIG. 10 is a view showing the supplemental bristles of FIG. 9 seen from the top of the hairbrush.

Furthermore, another embodiment of a hairbrush according to the present invention is illustrated in FIGS. 9 and 10. The hair brush has a brush base member 1 and brush bristles 2 longitudinally provided on the brush base member 1. The supplemental bristles 3 are provided on both sides of the respective brush bristles 2 with being slant downwardly (from the tip sides toward the root sides of the brush bristles 2). In addition thereto, standing bristles 4 are provided on the brush base member 1 and they have second supplemental bristles on both side thereof. The second supplemental bristles are slant downwardly (in other words slant from tip sides toward the root sides of the standing bristles 4). The standing bristles 4 may be provided between the rows of the brush bristles 2, and/or outside of the lateral end rows thereof. This construction provides the synergistic effect with the supplemental bristles 3 and the second supplemental bristles 5. And the synergistic effect from the use of the hairbrush preferably may allow hair to easily enter deep to the root portions of the brush bristles 2 and prevent the hair from unwanted slipping off from the root portions of the brush bristles 2.

With the hairbrush according to the present invention, hair is blown to be styled or curled as follows.

Figure 11:
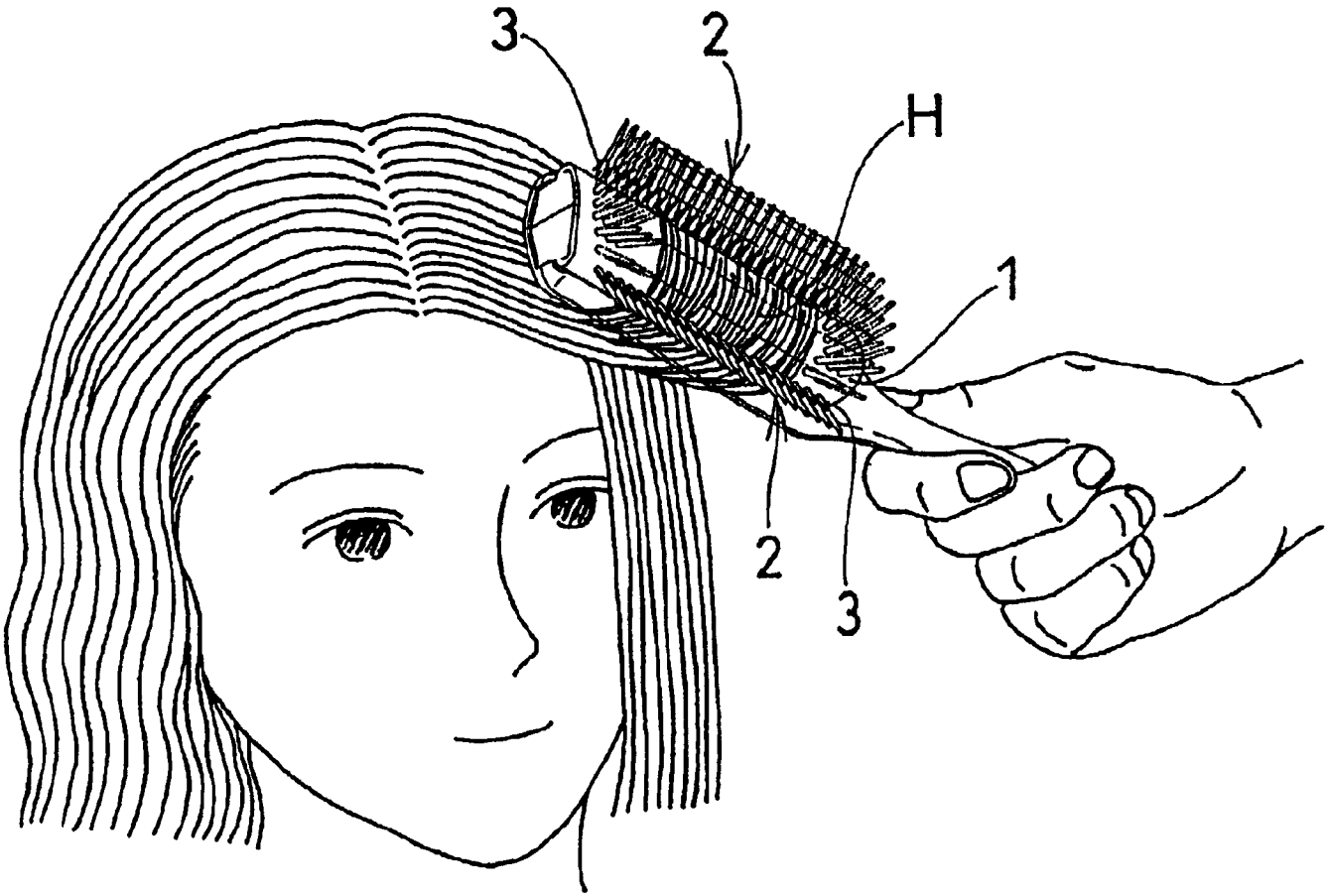
FIG. 11 is a view showing one example how the hairbrush according to the present invention is used.
Figure 12:
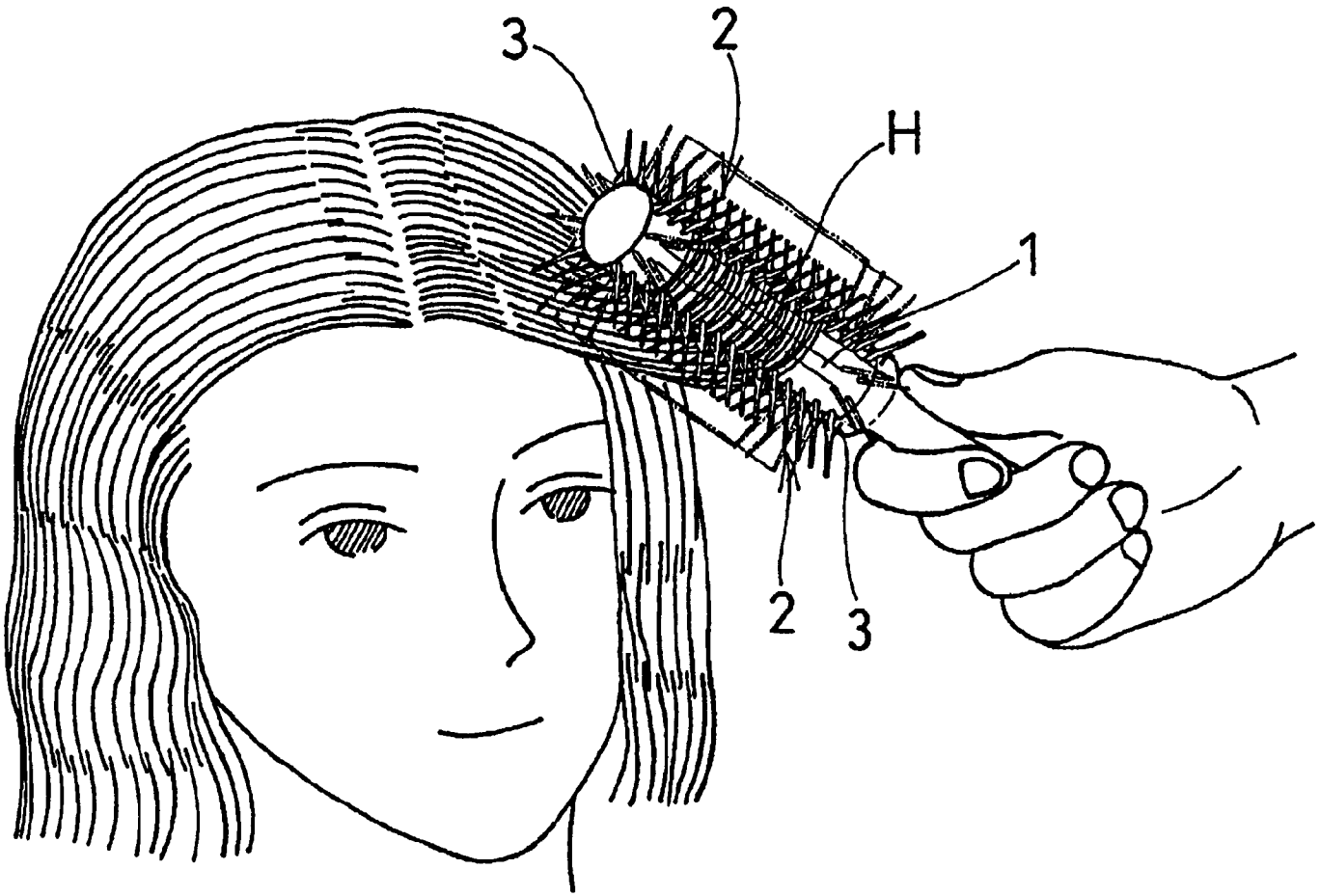
FIG. 12 is a view showing another example how the hair brush according to the present invention is used.

When hair is blown to be styled to flow smoothly, hair is applied with a necessary amount of hair lotion, and is combed with the hairbrush shown in FIG. 1. The hair H is raised as shown in FIG. 11, and entangled on the brush bristles 2 and pulled to be further raised. When hair is curled, hair is applied with a necessary amount of hair lotion, and combed with the hairbrush shown in FIG. 2. The hair H is raised as shown in FIG. 12, and entangled on the brush bristles 2 and pulled to be further entangled around the brush base member 1.

Figure 13:
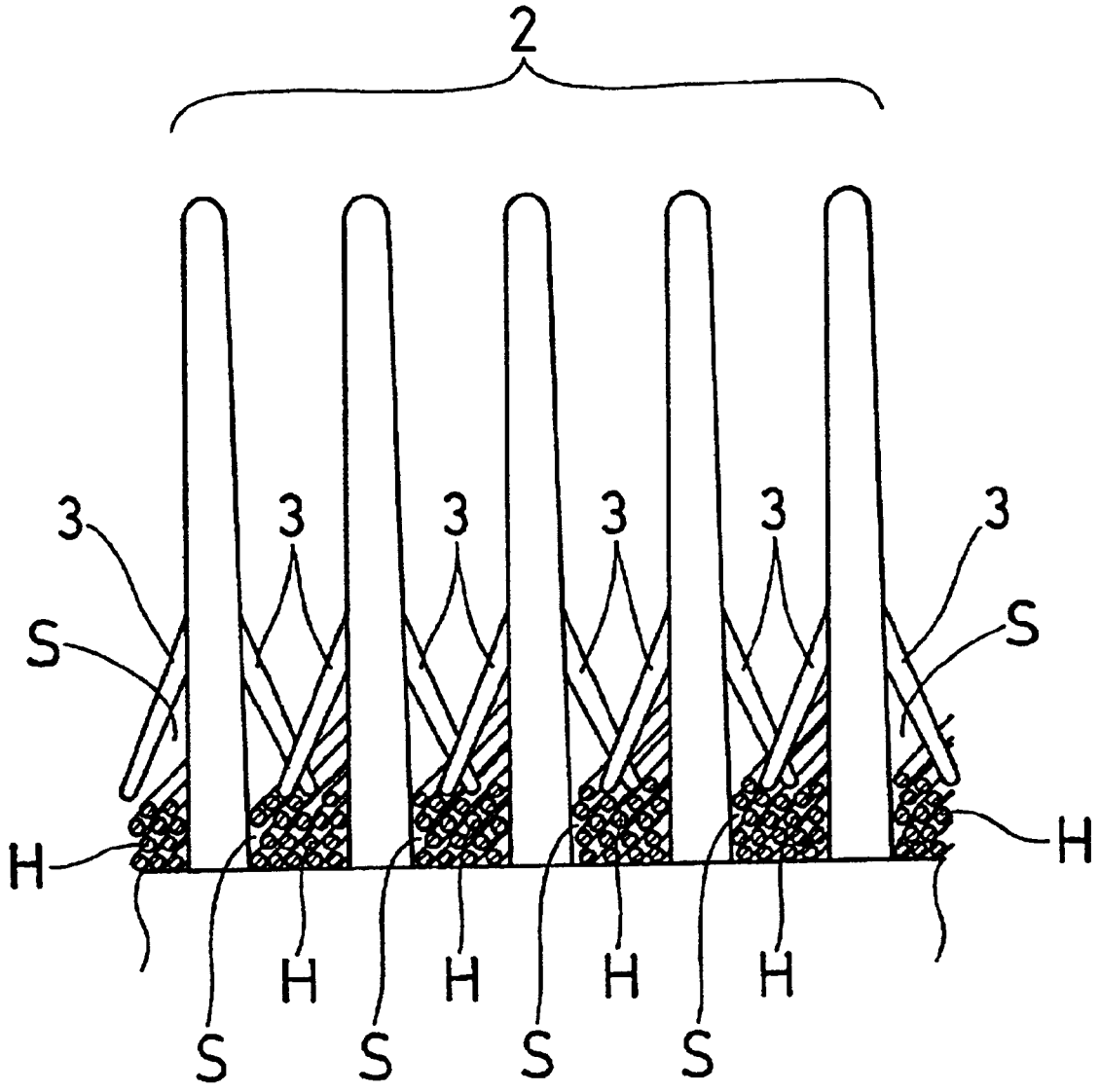
FIG. 13 is a view showing a state in which the hairbrush according to the present invention is in use and hair is caught in the spaces surrounded with the brush bristles and the supplemental bristles of the hairbrush.

Then, in both cases, as shown in FIG. 13, hair H enters deep into the spaces S surrounded with the brush bristles 2 and the supplemental bristles 3, and hair H is prevented from easily slip off from the root portions of the brush bristles 2. Therefore, the hair may be easily held in the foregoing raised state or in the foregoing entangled state around the brush base member 1. As a result, the hair being held in such states may be easily warmed by a hairdryer and given waves and/or curls thereon, and styling hairdos may be preferably done.

The hairbrush shown in FIG. 3 may be used like the one in FIG. 2 after a necessary amount of hair lotion being applied on hair, if needed. Hair H is combed with the hairbrush, raised and entangled on the brush bristles 2 and pulled to be further twined around the brush base member 1. In this state, the hairdryer D is set to be on, the hair H is warmed to be waived or curled. So that hair being held as above is quickly curled. In this hairbrush, warmed air from the hairdryer D blows out from a plurality of apertures B provided on the brush base member 1. In case the brush bristles without supplemental bristles 3, hair H is blown up and easily slips off from the brush bristles 2. However, in case the brush bristles 2 with supplemental bristles 3 , even if hair H is blown up, since hair H is caught deep in the space surrounded with the brush bristles 2 and the supplemental bristles 3, hair H may be prevented from unwanted slipping off from the root portions of the brush bristles 2.

Being constructed as stated above, the hairbrush according to the present invention may enable to reliably hold hair being raised with the hairbrush or being entangled around the brush base member, so that styling hairdos may be easily done with it.

What is claimed is:

1. A hairbrush having a brush base member and brush bristles provided thereon, wherein some of the brush bristles have supplemental bristles thereon at positions lower than a middle of a height the respective brush bristles.

2. The hairbrush according to claim 1, wherein the brush bristles are made of hard bristles and the supplemental bristles are made of soft bristles.

3. The hairbrush according to claim 1, wherein each of the supplemental bristles is provided on a side of each of the brush bristles longitudinally disposed on the brush base member, and the supplemental bristles respectively slant from tip sides toward root sides of the brush bristles.

4. The hairbrush according to claim 1, wherein each of the supplemental bristles is provided on one side of each of the brush bristles longitudinally disposed on the brush base member, and the supplemental bristle respectively slant from tip sides toward root sides of the brush bristles and intersect with respective neighboring brush bristles.

5. The hairbrush according to claim 1, wherein the supplemental bristles are provided on both sides of respective brush bristles longitudinally disposed on the base member, and the supplemental bristle respectively slant from tip sides toward root sides of the brush bristles and intersect with respective supplemental bristles provided on neighboring brush bristles.

* * * * *